United States Patent [19]

Hapgood et al.

[11] 3,936,003

[45] Feb. 3, 1976

[54] MULTIPORT HIGH DENSITY BURNER

[75] Inventors: William H. Hapgood, Brookline; Donald G. Protopapas, Wilmington, both of Mass.

[73] Assignee: Raytheon Company, Lexington, Mass.

[22] Filed: Oct. 11, 1974

[21] Appl. No.: 513,962

Related U.S. Application Data

[63] Continuation of Ser. No. 420,825, Dec. 3, 1973, abandoned, which is a continuation of Ser. No. 372,363, June 21, 1973, abandoned, which is a continuation of Ser. No. 215,656, Jan. 5, 1972, abandoned, which is a continuation of Ser. No. 2,584, Jan. 13, 1970, abandoned, which is a continuation-in-part of Ser. No. 787,915, Dec. 30, 1968, abandoned.

[52] U.S. Cl. ..... 239/559; 239/553; 239/557; 431/354; 431/8

[51] Int. Cl.[2] ..... B05B 1/14

[58] Field of Search ..... 431/7, 8, 177, 328; 239/556, 557, 559, 553, 567

[56] References Cited

UNITED STATES PATENTS

| | | | |
|---|---|---|---|
| 14,414 | 3/1856 | Shaw | 239/430 |
| 245,416 | 8/1881 | Turner | 239/567 |
| 1,377,732 | 5/1921 | Schreder et al. | 126/85 |
| 1,431,633 | 10/1922 | Clements | 431/12 |
| 1,636,643 | 7/1927 | Morabito | 431/177 |
| 2,755,851 | 7/1956 | Dow et al. | 239/559 |
| 2,799,288 | 6/1957 | Knight | 431/90 |
| 2,961,859 | 11/1960 | Joy | 431/328 |
| 2,980,104 | 4/1961 | Patrick et al. | 431/328 |
| 3,324,924 | 6/1967 | Hailstone et al. | 431/328 |
| 3,416,735 | 12/1968 | Reed | 239/567 |
| 3,445,175 | 5/1969 | Krieger | 431/328 |
| 3,592,574 | 7/1971 | Zenkner | 431/90 |

OTHER PUBLICATIONS

Chapter 12 of Section 12 of the Standard Gas Engineers Handbook of the American Gas Association entitled Gas Engineers Handbook, published 1966 by the Industrial Press, 93 Worth St. N.Y., N.Y.

*Primary Examiner*—Carroll B. Dority, Jr.
*Attorney, Agent, or Firm*—Elmer J. Gorn; Joseph D. Pannone; Milton D. Bartlett

[57] ABSTRACT

A burner for burning a mixture of a combustible gas and air including a curved wall member provided with a multiplicity of ports distributed throughout a substantial area of the wall. The ports are arranged in an ordered pattern such that every port, with the exception of a few along the edges of the burner, is surrounded by a plurality of closely adjacent ports. The size of each port and the distance between adjacent port edges are such that the jets of the gas-air mixture which issue from the ports merge into a common body of such mixture and form a closed lower pressure pocket around each port below such common body. The outer edges of such pocket are located above the minimum ignition level of each port and below the normal outer flame reach distance of the burner for the gas-air mixture supplied to the burner. As a result the flame produced by the burner may be stabilized in either of two regimes or in a combination of both depending upon the rate at which the mixture is supplied to the burner. One is in the form of a jet of flame adjacent each port stabilized by return eddies of hot gases into the pocket surrounding the jet. The other is in the form of a complex sheet of flame stabilized, at least in part, by a portion of the flame located at lower velocity regions between higher velocity jet regions.

6 Claims, 4 Drawing Figures

INVENTORS
WILLIAM H. HAPGOOD
DONALD G. PROTOPAPAS
BY Joseph D. Pannone
ATTORNEY

MULTIPORT HIGH DENSITY BURNER

This is a continuation of application Ser. No. 420,825 filed Dec. 3, 1973 (now abandoned), which is a continuation of application Ser. No. 372,363 filed June 21, 1973 (now abandoned), which is a continuation of application Ser. No. 215,656 filed Jan. 5, 1972 (now abandoned), which is a continuation of application Ser. No. 2,584 filed Jan. 13, 1970 (now abandoned), which is a continuation in part of application Ser. No. 787,915 filed Dec. 30, 1968 (now abandoned).

BACKGROUND OF THE INVENTION

1. Field of the Invention

Multiple port burners for burning a mixture of hydrocarbon gas and air.

2. Description of the Prior Art

Most prior art gas-air mixture burners are of the type in which the flame produced is typical of the Bunsen Burner flame. Such a flame is produced by a substantial laminar jet of mixture issuing from a tube or port. As is well known, for each mixture of gas and air a flame is propagated in such mixture by a combustion wavefront progressing into the mixture at a velocity, usually designated as $S_u$ which, in the case of a laminar jet of a stoichiometric hydrocarbon gas-air mixture, is about 40 cm/sec. If the velocity conditions in the jet are such that there is a region close to the rim of the port at which the component of velocity of the jet in a direction away from the port is equal to $S_u$ for the instance involved, the base of the flame will stabilize at such location. If, however, the velocity of the jet issuing from the port is increased, a point is reached at which the gas velocity exceeds the burning velocity $S_u$ at every point and the combustion wave blows off, extinguishing the flame. Each individual port has a definite blow-off velocity for each gas-air mixture supplied to it. The term "blow-off velocity" as used in the specification and claims herein means that velocity at which, for the gas-air mixture involved and with an isolated port of a given size and with no auxiliary flame sustaining mechanism, the base of a flame at said port will move away from said port and extinguish such flame.

The above phenomenon has imposed a limit on the amount of heat energy which can be delivered by any Bunsen burner type of burner port. Typically such ports have been operated with maximum jet velocities of about two to four times the value of $S_u$ for the mixture supplied to the port. Where it is desired to supply more heat energy than is available from a single burner port, the prior art has produced burners with a multiplicity of such ports. However, the ports were arranged so as to retain essentially the characteristics of isolated ports of the nature already described. As a result, high energy level burners have been quite large. Also, they have had a tendency to be noisy and to generate appreciable quantities of CO in their combustion products.

Chapter 12 of Section 12 of the standard gas engineers handbook of the American Gas Association entitled GAS ENGINEERS HANDBOOK, published in 1966 by The Industrial Press, 93 Worth Street, New York, New York, Library of Congress Catalog Card Number 65-17328, discloses that for stability multiport burners require either operation with primary air less than 100% of the air required for complete combustion, hence producing a secondary air requirement, or auxiliary flame reignition, for example by radiant energy or another jet at right angles to the main jet.

Recent developments of compact high efficiency heat transfer modules, such as those described in the copending application of William H. Hapgood, Ser. No. 737,135, Filed June 14, 1968 and now abandoned, have created the need for a similarly compact, highly efficient burner capable of handling fuel inputs of the order of up to 20,000 BTU per hour per square inch of burner surface or even higher. Prior art type burners have not been able to supply this need.

SUMMARY OF THE INVENTION

In the present invention, the limitations of the prior art have been overcome by providing a curved wall member, preferably in the form of a cylinder, perforated by a multiplicity of small ports distributed in an ordered pattern throughout the entire wall member. Virtually every port is surrounded by a plurality of closely adjacent ports with the angular deviation between the center lines of adjacent ports being less than the characteristic jet angle of said ports. The ports are of such size and spacing and the porosity of the wall member is of such value that the burner is able to deliver very large amounts of heat energy with a high degree of stability with low noise and high efficiency. The burner is supplied with a predetermined mixture of a combustible gas and air at velocities through the ports at much higher multiples of the normal combustion wave velocity of the mixture than has been practicable in prior art devices.

Where the port pattern presents a higher spacing between adjacent port edges in one direction than in another, the direction of higher spacing is oriented along the direction of minimum curvature of the wall member. One end of the cylindrical burner is closed by a concave cap which avoids liftoff of the flame at said end.

DETAILED DESCRIPTION OF THE INVENTION

Figure 1:
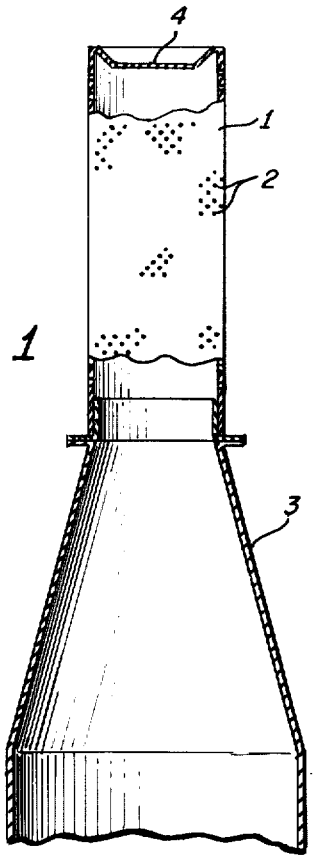
FIG. 1 is a vertical view, partly in section of a burner constructed in accordance with this invention.
Figure 3:
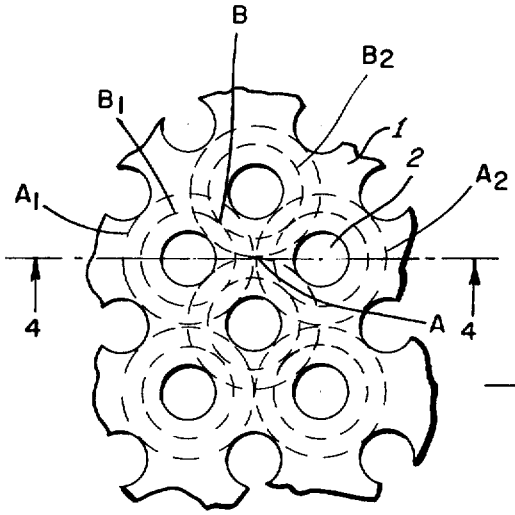
FIG. 3 is an enlarged view of a small portion of the side wall member of the burner of FIG. 1.

The burner illustrated in FIG. 1 is constructed of a sheet 1 of a metal such as stainless steel rolled into a cylindrical configuration. A typical size of cylinder has been one having a diameter of 1.7 inches and a height of 4 inches resulting in a burner surface of 21.36 square inches capable of delivering heat energy at a rate in excess of 400,000 BTU per hour. Sheet 1 is provided with a multiplicity of perforations 2 which serve as ports through which gas to be burned issues. These ports are disposed in an ordered pattern throughout the sheet 1. The basic pattern illustrated in the drawings is a square, although other patterns such as a hexagon may be used. As will be described below, the characteristics of the burner is dependent in part on the spacing between the edges of adjacent ports and the angular divergence between jets of gas issuing from adjacent ports. Therefore, where the geometric pattern of the ports provides different spacing between such edges in different directions across the pattern, such pattern preferably is arranged with the direction of the greatest spacing between port edges along the direction of the minimum curvature of the burner wall. In the case of a square pattern, the diagonal of the square represents the direction of the greatest distance between adjacent port edges and so the pattern as shown in FIG. 1 and FIG. 3 is arranged with a diagonal disposed parallel to the vertical axis of the burner cylinder which is the direction of zero curvature.

An inlet conduit 3, through which a predetermined mixture of air and a hydrocarbon gas, such as natural gas, gasoline, methane or propane, may be supplied to the burner, is connected to one end of the cylindrical sheet 1. The other end of said sheet is closed by a solid end plate 4. Plate 4 is made slightly concave for a purpose to be described below.

Figure 2:
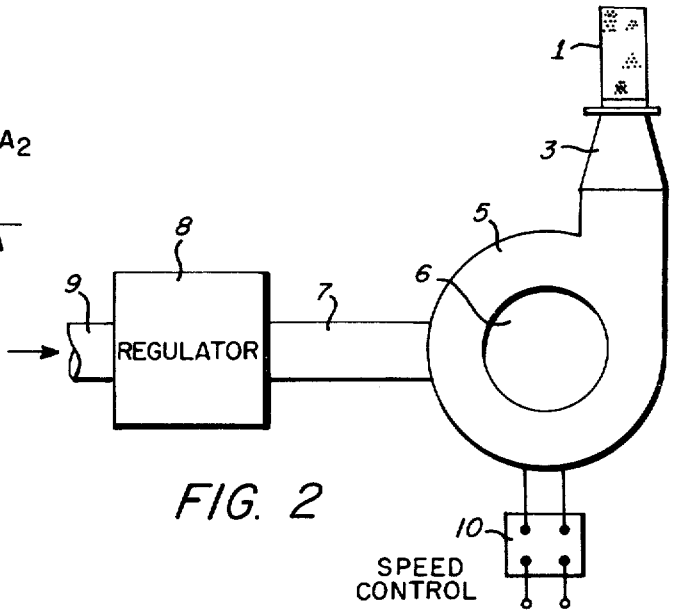
FIG. 2 is a diagrammatic showing of the burner of FIG. 1 connected to a regulated supply of a gas-air mixture.

As shown in FIG. 2, a blower-mixer 5 is connected to the outer end of conduit 3. The blower-mixer 5 receives air through an inlet passage 6 and the combustible gas, through an inlet pipe 7. The pipe 7 in turn is supplied with the gas from a regulator 8 which regulates the flow of gas, introduced through inlet 9 from a suitable gas supply. The regulator 8 is adjusted to control the flow of gas to a level at which it forms any desired proportion of the gas-air mixture flowing through conduit 3. Ideally, the mixture should consist of a stoichiometric mixture of gas and air, although for most purposes it is preferred to use an excess of air up to about 30% excess, so as to insure against the presence of CO in the combustion products of the burner. The speed of the blower-mixer 5 is controlled by a suitable speed regulator to select the velocity of the flow of the mixture through the ports of the burner. The components 5, 8 and 10 may be any well known readily available commercial devices and, since their details are not part of the present invention, they will not be described in detail herein.

A critical aspect of this invention resides in the relationships between port size, port spacing, burner porosity and the curved nature of the burner wall. By the term "porosity", as used herein, is meant the percentage of any given area of burner which is occupied by the open areas of the ports in said given area. The above factors must be chosen in accordance with the criteria which will be explained below. However, typical examples of burners constructed in accordance with this invention have included port diameters in the range of about 0.02 inches to 0.04 inches arranged in square or hexagonal patterns. Porosities have varied from about 15% to about 30%.

The blower-mixer 5 has been operated to supply the gas-air mixture through the ports 2 at velocities up to a value in excess of 1600 cm. per sec. which is forty times the normal combustion wave velocity for the mixture involved. This is about ten times the maximum jet velocities normally used in the Bunsen burner type of operation.

Figure 4:
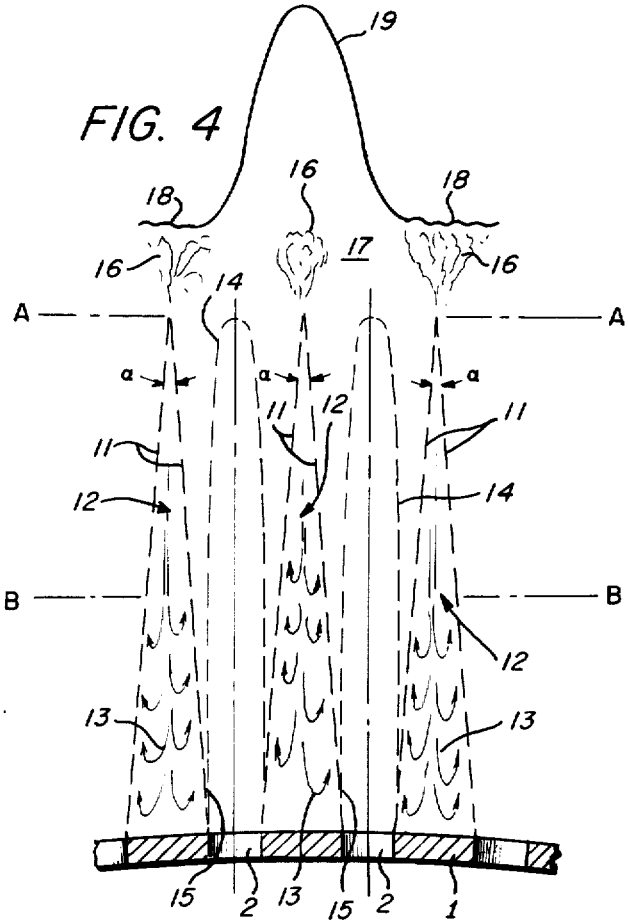
FIG. 4 is a still further enlarged section taken along line 4—4 of FIG. 3 and containing a diagrammatic representation of the nature of the flame structure adjacent each port of the burner.

In FIG. 4, the dashed lines 11 represent the boundaries of jets of gas issuing through ports 2 which would ideally exist under constant temperature conditions. The angular spread of each such jet would be 14° so that in FIG. 4 the angle existing at the point of intersection between adjacent lines 11 is 14°. Under operating conditions the temperature of each jet may rise sharply as it progresses from its port 2. This would tend to produce a more sharply diverging angle for each such jet. However, for the purpose of definiteness in specifying the critical criteria for the proper design of a burner according to this invention it is useful to use such value of 14°. The term "characteristic jet angle" used herein means such angle at which a jet of gas issuing from such port would diverge under constant temperature conditions.

The boundaries 11 from adjacent ports intersect at a level A—A beyond the surface of sheet 1. This corresponds to the point A at which the dotted circles A and A2, drawn concentrically with the two ports shown in FIG. 4, touch each other. However, if instead of looking at the diagonal of the square pattern, we consider two adjacent ports along one side of the square pattern, it will be seen that two smaller circles $B_1$ and $B_2$ drawn concentrically with said ports will touch each other at a point B corresponding to the level B—B in FIG. 4. From this it will be seen that jets issuing at the characteristic jet angle from any given port 2 and from the adjacent ports surrounding such port 2, will merge to define a closed ring-like pocket 12 of generally triangular cross-section and bring a maximum height at level A and a minimum height at level B. Pocket 12 represents a region lying outside the jet issuing from the port involved and when, during actual operation such a closed pocket is formed it constitutes a relatively low pressure region into return gas eddies 13 from the higher pressure merged body 17 of gas above levels A—A and B—B may flow. Operation of a burner in accordance with this invention is dependent to a considerable degree upon the formation of such a closed pocket around substantially every port in the burner, except for those few ports which lie along the upper and lower boundaries of the perforated sheet 1.

In the case of a square pattern of 0.027 inch diameter ports with a density of 400 ports per square inch resulting in a porosity of about 22 percent, the maximum height of pocket 12 would be 0.27 inches and its minimum height would be 0.114 inches.

When the gas-air mixture is supplied to the burner, it is ignited by any well known ignition device which is not shown in the drawings. At the lowest level of input, individual tongues of flame 14 may be established adjacent each port 2. The combustion wavefront of each such flame 14 is shown in dotted lines in FIG. 4. The base of each such flame will be stabilized at a point 15 closely adjacent its port. Although the velocity of the jet issuing from each port 2 may be above the blow-off velocity of such port, nevertheless the base of flame 12 is reliably stabilized. It is believed that this is due to the fact that the high temperature burned gases which are produced in the combustion wave progress along the jet path until they converge at the various levels along the top of pocket 12 into the merged body of gas 17. Whereas the jet flow of principally laminar, at the merger levels a moderate degree of turbulence 16 is set up immediately above the top of pocket 12. The pressure at such level is greater than the pressure existing in the pocket 12. As a result, return eddies 13 of hot gases flow from the merged body of gas 17 into the pocket 12. It is these return eddies which are believed to furnish a constant supply of ignition energy to the base of each jet so as to insure the stability of the flame.

As the velocity of the jets is increased, the length of the flame 14 increases. As the upper reaches of such flames extend further into the merged body of gas 17, a point is reached at which unburned gases escape into said merged body at which time the flame pattern is stabilized in a new regime. In this regime the flame appears as a continuous sheet of flame having a stable base level at a region generally designated at 18 and concentrically surrounding the cylindrical sheet 1 at a level, which typically may be ¼ inch to ½ inch away from the surface of said sheet. Region 18 may represent regions of moderate turbulence which established a combustion flame velocity in the direction of the surface of sheet 1 which matches the flow velocity of the expanding cylindrical merged body of gas. Due to the cylindrical symmetry of the system, the flow velocity is reduced with increasing distance from the surface of the burner. It is due to this factor that the combustion wave can find a stable position where the flow velocity and the burning velocity of the combustion wave are equal in magnitude. In addition to the region 18, higher velocity laminar jets 19 appear at many points throughout the sheet of flame. These are believed to be either individual higher velocity streams emanating from individual ports 2 or such higher velocity streams resulting from the merger of jets from two or more ports. The velocity gradients along the surface of the sheet of flame from the region 18 to the jets 19 are apparently quite small and the flame easily spreads from region 18 to the jets 19 so that the continuity of the combustion flame is never interrupted. The combustion wave is continuous and the heat release is remarkably constant in time. As a result, burners constructed in accordance with this invention are remarkably quiet, stable and efficient even at the highest heat release rates.

The above is only a general approximation of the phenomena which occurs in the present burner in which a very complex set of phenomena are present. Such approximation, however, is believed to be a useful tool in arriving at the criteria which should be satisfied in arriving at the proper design of burner according to this invention. There are a number of indications of the complexity which a complete explanation of the remarkable results achieved by the present invention would require. For example, it has been computed that, at the higher operating levels of a burner according to this invention, it would require a cylindrical surface about seven times that of the total surface of the burner sheet 1 to provide the 40 centimeter per second flow velocity to match the usual 40 centimeter per second combustion wave velocity. Such a surface would presume that the flame would have to be stabilized along a cylindrical level having a diameter of about seven times that of the burner. Actually, however, the flame is stabilized at a fraction of such distance. It is believed that even in the case of the merged sheet of flame, return eddies 13 of hot gases still operate to supply heat energy into the jets of gas producing a preheating action which contributes to the establishment of the very compact and high density flame of this invention. Other phenomena are undoubtedly also present to contribute to such result.

Since the formation of the closed pockets 12 and the merged body 17 are of importance in the design of the present burner, it will be noted that such design should provide that the boundaries 11 of adjacent ports intersect. Since the ports which are spaced along the curvature of sheet 1 have their center lines diverging on an angle dependent on such curvature and on the spacing between the center of such ports, it should be noted that if such angular divergence equals or exceeds the characteristic jet angle of the ports, then boundaries 11 will never intersect. At the characteristic jet angle, two adjacent boundaries 11 will be parallel to each other and at greater angles they will diverge from each other. Therefore, one of the criteria to be observed is that the ports must be spread along any curvature of the burner surface so that the angular divergence between their center lines will be less than the characteristic jet angle of the ports.

Not only should the boundaries intersect to form the pockets 12, but the height of each pocket should be close enough to the surface of sheet 1 to insure that the return eddies 13 rapidly reach the base of the pocket with sufficiently high energy content to produce the effects described above. It is believed that this is related to the size of the port involved. The height of each pocket 12 is dependent, not only on the geometry of the characteristic jet angle, but also on the distance between the edges of adjacent ports. That distance is more readily under the control of the burner designer than is the characteristic jet angle. In general, it has been found that if the maximum distance between the edges of adjacent ports is of the order of the diameter of each such port or less, such design will be well within the limits imposed by the above requirement.

Another way of looking at the criteria of port size and spacing is by considering the porosity of the burner. A porosity of 18 percent is about in the middle of the desired range. The The porosity range of about 15 percent to about 30 percent referred to above appears to be well within the acceptable range for this criterion.

As has been described, the curvature of the sheet 1 is of importance in the stabilizing of the base level 18 of the sheet of flame which occurs in the merged flame regime of the burner. As the radius of curvature becomes greater, there is a tendency for such sheet of flame to become unstable, which tendency becomes high in the case of a perfectly flat burner and becomes even worse as the burner surface becomes concave. This apparently is due to the fact that the velocity of the merged body does not fall off as it progresses continually from the surface of sheet 1 as it does with a convex-curved burner surface. Cylindrical burners having a diameter of the order of about 2 inches or less have curvatures which lie well within this aspect of the present invention.

One aspect of the present burner is that, although it delivers an extraordinary concentration of heat energy, the burner sheet remains relatively cool so that it is not deteriorated by any high temperature effects. This is partly due to the cooling effect of the large volume of the gas-air mixture flowing through the ports 2 during the normal operation of the burner. The lower limit of prior art burners is reached when the velocity of the issuing jet of gas is reduced to a level at which the normal combustion wave velocity exceeds the jet velocity at all points and therefore the flame travels to the edges of its port where it either flashes back into the port or is otherwise extinguished. In the present burner, the lower limit of operation is reached when the flames approach close enough to the burner surface to deliver heat to that surface in excess of the ability of the gas-air mixture to cool it to an acceptable level. Connection of the sheet 1 to the conduit 3 by a high thermally conductive joint enables the conduit 3 to contribute to the cooling of sheet 1 and thus reduces the acceptable lower limit of operation of this burner.

It will be noted that the topmost row of ports at the upper end of the burner in FIG. 1, necessarily have adjacent ports only below it. Therefore, these few end ports, as well as the corresponding ports at the lower end of the burner do not satisfy all of the criteria which the vast majority of the ports do satisfy. However, the effect of such vast majority predominates so that the end effects are minimal. Nevertheless, it is desirable that no additional adverse effects should exist at such ends. For this reason it is desirable that the velocity of the mixture which issues from the jets be substantially the same at the ends as throughout the rest of the burner. In the cylindrical configuration in FIG. 1, the lower end of the burner does not appear to present any problem in this area. However, there is a tendency for the velocity of the jets issuing from the ports at the upper end of the burner to be greater than the velocity of the rest of the jets. However, the simple expedient of making the end plate 4 slightly concave eliminates this tendency. In a typical case the depth of concavity is about ¼ inch.

It is believed that the above effect is due to the following phenomena. As the gas-air mixture flows upwardly through the central portion of the burner, it reaches the upper end of the burner before its velocity drops to zero. Therefore, the stream possesses a substantial amount of kinetic energy and upon impinging on the closed end of the burner, such kinetic energy is converted into a substantial increase in pressure at that point. If the central area at which such increase in pressure occurs were to lie too close to the ports at the end of the burner, that pressure would not be able to decrease to the level which exists at all of the other ports, and flame at the end ports would tend to lift off. By depressing the central portion of the end plate 4, the distance between such increased pressure area and the periphery of the burner is increased sufficiently to allow the desired pressure equalization to take place.

Burners constructed in accordance with the principles of this invention as described above have proved to be capable of delivering enormous amounts of heat energy within a very small volume of space. At the same time, they are quiet and highly efficient. Their simplicity leads to economy of cost of production and to long life with a minimum of maintenance.

What is claimed is:

1. In combination:

a multiport burner wall member substantially surrounding a plenum;

said wall member having a plurality of circular ports having a diameter in the range of 0.02 in. to 0.04 in. distributed in a uniform pattern having a plurality of rows about the circumference of said wall and throughout a substantial portion of the height of said wall member;

said portion having a curved surface area;

each of said ports being adjacent to a plurality of other ports;

the total area of said ports being between 15% and 30% of said wall portion;

the angular divergence between the center lines of adjacent ports in said curved surface area being less than 14 degrees;

means for producing a flame front outside said plenum extending across the regions between adjacent jets and spaced from said wall member comprising a blower for supplying a fuel-air mixture to said plenum at a pressure producing jets of said fuel-air mixture through said ports having velocities substantially greater than the combustion wave velocity of said mixture; and ignition of said fuel-air mixture within said plenum being prevented by said wall member.

2. The combination in accordance with claim 1 wherein:

said fuel-air mixture has greater than 100% of the air required for complete combustion of said fuel.

3. The combination in accordance with claim 1 wherein:

said wall member is substantially cylindrical.

4. The combination in accordance with claim 1 wherein:

said curved surface area has a direction of minimum curvature; and said ports are arranged in said pattern with a greater spacing between edges of adjacent ports along said direction of minimum curvature than in other directions.

5. The combination in accordance with claim 1 wherein:

said means for supplying said fuel-air mixture to said plenum comprises a fuel regulator for supplying said fuel as a gas to the input of said blower at a predetermined pressure; and said regulator varying the volume of said gas supplied to said blower substantially in proportion to the volume of said fuel-air mixture passing through said blower.

6. The combination in accordance with claim 1 wherein:

said means for supplying said fuel-air mixture comprises means for supplying said fuel as a gas to the input of a blower.

* * * * *